US009082285B2

(12) United States Patent
Kim

(10) Patent No.: US 9,082,285 B2
(45) Date of Patent: Jul. 14, 2015

(54) SYSTEM AND METHOD FOR DETERMINING VEHICLE DRIVING STATUS INFORMATION-BASED DRIVING CONCENTRATION

(75) Inventor: Jae Hee Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 322 days.

(21) Appl. No.: 13/368,481

(22) Filed: Feb. 8, 2012

(65) Prior Publication Data

US 2013/0093888 A1 Apr. 18, 2013

(30) Foreign Application Priority Data

Oct. 17, 2011 (KR) ..... 10-2011-0106078

(51) Int. Cl.
*G08B 21/06* (2006.01)

(52) U.S. Cl.
CPC ..... *G08B 21/06* (2013.01)

(58) Field of Classification Search
CPC . B60K 28/063; B60K 28/06; B60W 2540/24; G01N 33/4972; G01N 21/3504; H04N 7/18
USPC ..... 348/148
See application file for complete search history.

(56) References Cited

U.S. PATENT DOCUMENTS

2005/0030184 A1 2/2005 Victor
2005/0219057 A1* 10/2005 Ihara et al. ..... 340/575
2007/0084661 A1 4/2007 Brosig et al.
2007/0124027 A1 5/2007 Betzitza et al.
2007/0268146 A1* 11/2007 Itou ..... 340/576
2011/0279676 A1* 11/2011 Terada et al. ..... 348/148

FOREIGN PATENT DOCUMENTS

| | | | |
|---|---|---|---|
| EP | 1 914 106 | | 4/2008 |
| JP | 09-011773 | A | 1/1997 |
| JP | 09270098 | A | 10/1997 |
| JP | 10-181380 | A | 7/1998 |
| JP | 2000211543 | A | 8/2000 |
| JP | 2001-213189 | A | 8/2001 |

(Continued)

OTHER PUBLICATIONS

L.M. Bergasa et al: "Real-Time System for Monitoring Driver Vigilance", IEEE Transactions on Intelligent Transportation Systems, vol. 7, No. 1, Mar. 1, 2006, pp. 63-77.

*Primary Examiner* — Dave Czekaj
*Assistant Examiner* — Berteau Joisil
(74) *Attorney, Agent, or Firm* — Mintz Levin Cohn Ferris Glovsky and Popeo, P.C.; Peter F. Corless

(57) ABSTRACT

A method and system for determining driving concentration which is capable of analyzing a driver's driving concentration on the basis of variation of a steering angle and driving status information of a vehicle acquired from a front camera sensor. The method includes storing output data of a steering angle sensor and a front camera sensor mounted in a vehicle at a predetermined time interval, calculating a quantitative index include a value for recognizing a vehicle status based on information stored in a storage unit, statistically processing the calculated value to output status information which is an index for determining driving concentration, and comparing the information calculated in the statistically processing to the predetermined reference data and determining the driving concentration according to the comparison result.

14 Claims, 3 Drawing Sheets

(56) References Cited

FOREIGN PATENT DOCUMENTS

| | | | |
|---|---|---|---|
| JP | 2002-183900 | A | 6/2002 |
| JP | 2008186263 | A | 8/2008 |
| KR | 10-0899660 | | 5/2009 |
| KR | 10-2010-0028253 | | 3/2010 |
| WO | 2005/035321 | | 4/2005 |

* cited by examiner

SYSTEM AND METHOD FOR DETERMINING VEHICLE DRIVING STATUS INFORMATION-BASED DRIVING CONCENTRATION

CROSS-REFERENCES TO RELATED APPLICATIONS

This application claims priority to Korean patent application No. 10-2011-0106078 filed on Oct. 17, 2011, the disclosure of which is hereby incorporated in its entirety by reference.

BACKGROUND OF THE INVENTION

1. Field of the Invention

The present invention relates to technology for determining driving concentration of a driver during driving, and more particularly, to a method and system for determining driving concentration based on vehicle driving status information, which analyzes driving concentration of a driver based on a variation in a steering wheel angle and vehicle driving status information acquired through a front camera sensor.

2. Description of the Related Art

With an increase in the use of automobiles which have become necessities in modern society, the occurrence of traffic accidents has also increased rapidly. Traffic accidents can occur for many different reasons, among them being driver negligence and unexpected risks due to the road conditions. Among these factors, a couple of the most common causes are speeding or drowsiness. These conditions can cause serious accidents leading to personal injury or even death.

A study of 2.5 million traffic accidents occurring within one year by a national highway traffic safety administration (NHTSA) shows 25% to 56% of accidents are caused by a driver's careless driving. The three main factors causing this careless driving are sight negligence, mental concentration negligence, and drowsiness.

In an effort to solve the above problem, major automobile manufacturers have continued to develop various new systems for assisting driver's in safe vehicular operation and apply these new systems to the vehicles. Some manufactures have developed techniques which are able to determine when the driver is becoming drowsy by sensing a driver's reactions and movement using a camera or by monitoring the driver's pulse through a sensor.

When using the above described camera method, the camera photographs the driver's face via a camera installed inside a vehicle, processes the photo and analyzes the photo to recognize drooping and blinking patterns of the driver's eyelids and movement of the driver's pupils, and determines whether the driver is becoming drowsy based on the recognized result. In the pulse monitoring technique, the driver's pulse is used to determine whether the driver is becoming drowsy based on the reduction in the driver's pulse which often reduces as people fall asleep.

However, these previous techniques require very complicated and complex components such as the sensors and processors for detecting the driver's pulse rate and performing the analysis algorithm thereof or a camera for capturing the movement of pupils, hardware for processing the photographed images, and analysis algorithms thereof, are required. In addition, even when these components are included, only abnormal driving due to drowsy driving can be detected. Thus, the systems are economically inefficient in comparison with its intended result compared to the cost required to implement the system.

SUMMARY OF THE INVENTION

Various aspects of the present invention have been made in view of the above problems, and provide a method and system for determining driving concentration based on driving status information of a vehicle, which calculates an index for determining a driver's driving concentration based on variations in a steering wheel angle while driving and driving status information of the vehicle acquired through a front camera sensor. The present invention then converts a calculation result into statistical information, and determines the driver's driving concentration based on the statistical information.

According to an aspect of the present invention, a system for determining a driver's driving concentration based on driving status information of a vehicle is provided. The system may include: a steering angle sensor configured to sense displacement of a steering wheel; a front camera sensor configured to sense an object on a road and within a predetermined area in front of a vehicle; a data storage unit configured to store data provided from the steering angle sensor and the front camera sensor for a predetermined time interval and to accumulate a value calculated by an index calculation unit and manage the accumulated value as a standard value, according to a predetermined control data. The index calculation unit is configured to calculate a quantitative index for recognizing a vehicle's status based on data stored in the data storage unit according to a predetermined control data; a statistic processing unit configured to statistically process the value calculated by the index calculation unit and output status information which is an index for determining driving concentration. A driving concentration determination unit is configured to sequentially control the index calculation unit and the statistic processing unit based on the data stored in the data storage unit to calculate the status information and compare the calculated status information to the standard value stored in the data storage unit to determine a driver's driving concentration.

The system may further include a warning display unit configured to output a warning message to alert the driver of danger according to a predetermined control data. The driving concentration determination unit may control the warning display unit to output a warning message when a calculation result of the statistic processing unit is equal to or less than a predetermined reference value.

The driving concentration determination unit, the index calculation unit, and the statistic processing unit may be embodied within a control unit configured of an electronic control unit (ECU), or the like.

According to another aspect of the present invention, a method of determining a driver's driving concentration based on driving status information of a vehicle may include storing output data of a steering angle sensor and a front camera sensor mounted in a vehicle over a predetermined time interval in a storage unit; calculating a quantitative index for recognizing a vehicle status based on information stored in the storage unit; statistically processing a value calculated while calculating the quantitative index to output status information which is an index for determining driving concentration; and comparing the information calculated during statistical processing to the predetermined reference data and determining the driving concentration based on the comparison result.

The reference data may be acquired by accumulating a result calculated while calculating the quantitative index or during statistical processing at predetermined times through a statistical process.

The status information calculated during statistical processing may be configured of at least one parameter which subdivides the vehicle status. The reference data may also be subdivided so that the subdivided reference data is one-to-one compared to a corresponding parameter.

The method may further include determining a difficulty level associated with a road based on status information calculated by the statistical processing. This determination may include determining subdivided driving concentration by applying different reference values step by step according to a determination result in the determining the difficulty level of a road.

In some exemplary embodiments of the present invention, the parameter may include a difference between a number (e.g., ZERO) of sign change of a steering angle and a number (dSignR) of sign change of a radius of curvature of a road, and a value obtained by a variation factor (SDST %) of a Standard Deviation of STeering angle (SDST) in a maximum value (SDSTmax) of SDST measured for SDSTmax_s which is a standard value of SDST. The driving concentration determination may include first determining the driving concentration to a ○ maximum level when ZERO−dSignR=0 and a value of SDST % is less than a preset value V1.

If a value of a corresponding parameter is not matched to a maximum level condition in the first determination step, the determining the driving concentration may further include again determining the driving concentration to a minimum level when a number associated with lane exceedance (LANEX) is greater than a preset value V2. The parameter may include a value obtained by the variation factor (SDST %) of SDSTmax measured for SDSTmax_s which is a standard value for SDST.

The degree of difficulty of the road may be determined by the illustrative embodiment of the present invention. In particular, the difficultly level of the road may be low (i.e., a low level road) when the value of SDST % is greater than a preset value V3 and high (i.e., a high level road) when the value of SDST % is equal to or less than the preset value V3. By degree of difficulty it is meant the amount number of curves over a given section of road, the kind of curves, the sharpness of those curves, the incline of the road, etc.

Furthermore, the parameter may include a minimum value TLCmin of a time to line crossing (TLC) until a side of a vehicle reaches an adjacent line, and a variation factor (TLC %) in TLCmin measured for TLCmin_s which is a standard value of TLCmin. Determining driving concentration may further include determining a drivers concentration is at level 2 when a value of TLC % is less than a predetermined reference value V4 when it is determined that the road has a low difficulty level , or when the value of TLC % is less than a predetermined reference value V5 when it is determined that the road has a high difficulty level.

The parameter may include a Standard Deviation of Lateral Position (SDLP) in a lane, a maximum value (SDLPmax) of SDLP, and a variation factor (SDLP %) of SDLPmax measured for SDLPmax_s which is a standard value for SDLPmax. The driving concentration determination further includes determining the driving concentration is at a level 3 when the value of SDLP % is greater than a predetermined reference value V6 when it is determined that the road has a low difficulty level, or when the value of SDLP % is greater than a predetermined reference value V7 when it is determined that the road has a high difficulty level.

Determining the driving concentration may further include determining the driving concentration when the value of SDLP % does not satisfy a criterion of the level 3 to level 4 in determining the driving concentration.

The method may further, after determining the driving concentration, include counting the number of times that the driving concentration reaches a level 4 and resetting a parameter when the value counted in the counting the level 4 reaches a predetermined value, as the reference data.

According to the exemplary embodiment of the present invention, it is possible to calculate the driving concentration only using a steering angel sensor of a steering wheel (handle) and a front camera sensor originally mounted in a vehicle without using sensor information based on additional image or a physical data for measuring the actual physical changes of a driver biological condition.

In addition, it is possible to subdivide the driving concentration of the driver into several stages according to circumstances and symptoms and provide a difficulty level of a driving road which indicates an individual deviation according to driving ability of the driver.

Although a value set in releasing a vehicle is generally used as a reference value for determining the driving concentration, in the exemplary embodiment of the present invention, it is possible to correct concentration differences according to a deviation for each driver by deriving a value obtained by monitoring the drivers daily driving abilities and recording them as a threshold for each driver through continuous concentration determination tests and resetting the derived value as the reference value based on the driver's actual abilities. Thus, the illustrative embodiment of the present invention is dynamic in nature in that it has the ability to learn an individual driver's driving habits.

The system and methods of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION

Figure 1:
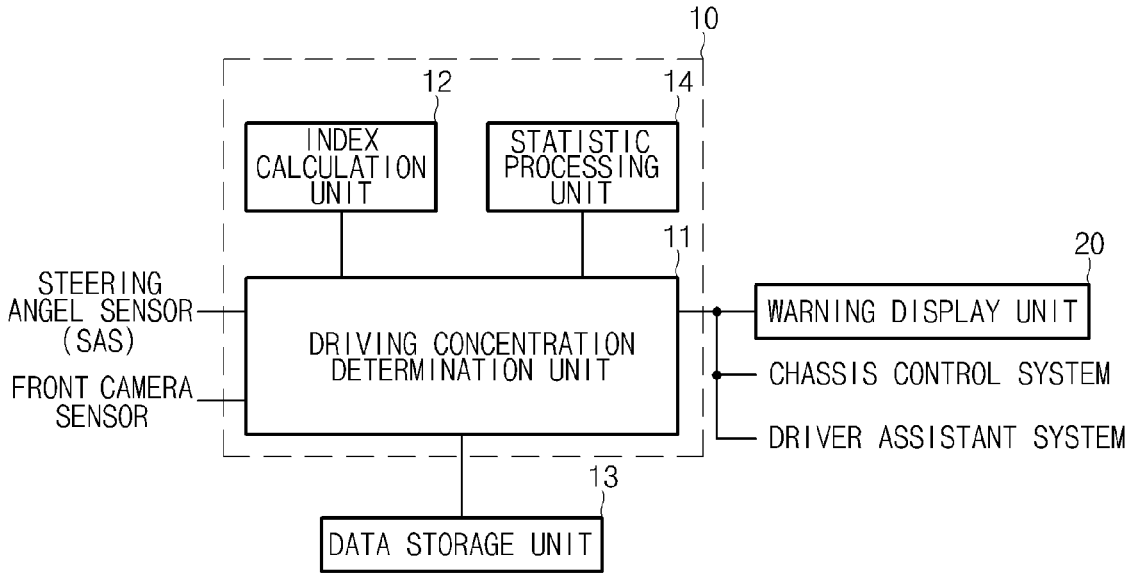
FIG. 1 is a functional block diagram illustrating a system for determining driving concentration based on driving status information of a vehicle according to an exemplary embodiment of the present invention.

Reference will now be made in detail to various embodiments of the present invention(s), examples of which are illustrated in the accompanying drawings and described below. Like reference numerals in the drawings denote like elements. When it is determined that detailed description of a configuration or a function in the related disclosure interrupts understandings of embodiments in description of the embodiments of the invention, the detailed description will be omitted.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

FIG. 1 is a functional block diagram illustrating a system for determining driving concentration based on driving status information of a vehicle according to an exemplary embodiment of the present invention.

In FIG. 1, a driving concentration determination unit 11 is configured to determine driving concentration based on sensor data from a steering angle sensor (SAS) and output data from a front cameral sensor, transmitted through a control area network (CAN) and to generate warning data when the driving concentration becomes less than a predetermined reference value.

An index calculation unit 12 is configured to calculate a quantitative index for recognizing a vehicle status based on the sensing data from the SAS and the output data from the front camera sensor. A data storage unit 13 is configured to store data provided from the SAS and the front camera sensor at a predetermined time intervals and to accumulate a value calculated by the index calculation unit 12 and manage the accumulated value as a standard value. A statistic processing unit 14 is configured to statistically process the value calculated by the index calculation unit 12 and output status information which is an index for determining the driving concentration.

Figure 3:
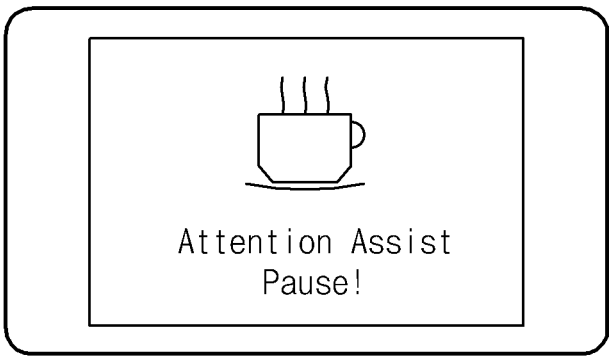
FIG. 3 is a view illustrating an operation of outputting a warning message.
Figure 3:
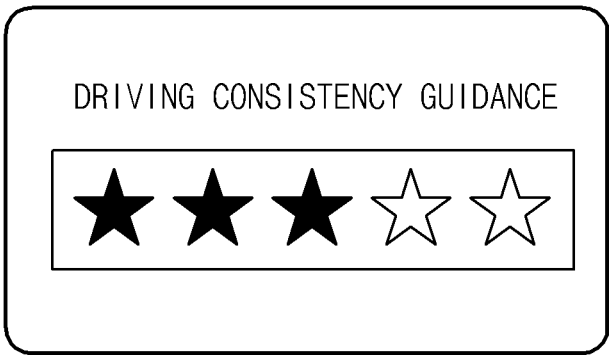

A warning display unit 20 is configured to output a warning message generated by the driving concentration determination unit 11 as shown in FIG. 3 when the driving concentration unit detects that the driver's concentration is below a predetermined threshold.

Although the driving concentration determination unit 11, the index calculation unit 12, and the statistic processing unit 14 may be integrally embodied in a control unit configured as an electronic control unit (ECU), the units may alternatively be embodied separately.

Figure 2:
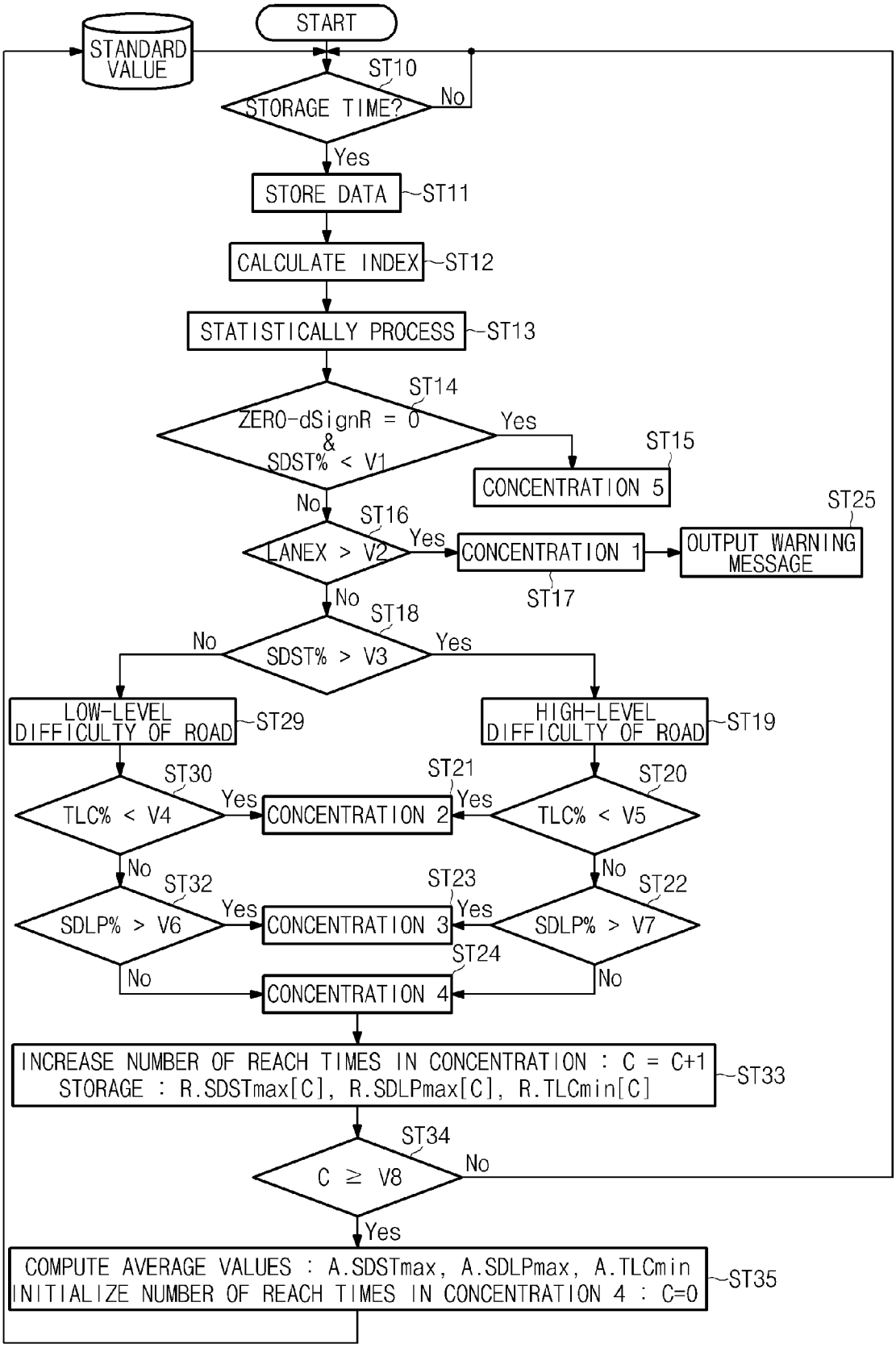
FIG. 2 is a sequence diagram illustrating an operation of the system for determining driving concentration having the configuration of FIG. 1.

Next, an operation of the system having the configuration will be described with reference to a flowchart of FIG. 2.

Various sensors mounted in the vehicle of the illustrative embodiment of the present invention are configured to sense measurement information required to determine a vehicle driving status and transmit the measurement information through the CAN. The driving concentration determination unit 11 periodically stores data detected through the SAS and the front camera sensor in the data storage unit 13 over constant intervals, for example, every 10 minutes or 30 minutes (ST10 and ST11) and controls the index calculation unit 12 to calculate an index value at a constant time interval according to a preset algorithm (ST12).

The index value calculated by the index calculation unit 12 includes a mean lateral position (MLP), a standard deviation of lateral position (SDLP), the number of lane exceedance (LANEX), a time to line crossing (TLC), and the like. The index calculated by the above-described process is processed as status information which is an index for determining the driving concentration by the statistic processing unit 14, and are provided to the driving concentration determination unit 11 (ST13). The information calculated as a statistically processed result includes a Standard Deviation of STeering wheel angel (SDST), a maximum value (SDSTmax) of SDST, a variation factor (SDST %) of SDSTmax measured for SDSTmax_s which is a standard deviation of vehicle's lateral position in a lane(SDLP), a maximum value (SDLPmax) of SDLP, a variation factor (SDLP %) of SDLPmax measured for SDLPmax_s which is a standard value, a time to line crossing (TLC) which means estimated time that one side of the vehicle reaches an adjacent line, a minimum value (TLCmin) of TLC, a variation factor (TLC %) of TLCmin measured for TLCmin_s which is a standard value. Additional standard value is computed by substituting the number of sign change in a radius of curvature of a road (dSignR) from the number of sign change in a steering angle (ZERO), and the like.

The driving concentration determination unit 11 compares the status information output from the statistic processing unit 14 to a preset reference value to determine driving concentration. First, when the difference between ZERO and dSignR, that is, ZERO−dSignR=0 and a value of SDST % is less than a preset value V1 (ST14), the driving concentration determination unit 11 determines the driving concentration of a driver who is currently driving the vehicle to be at a level 5 which is a very high level (ST15). This represents that the frequency of modification by a driver is low except for the effect from a road and that the stability of a lateral deviation of a vehicle is good. In response to the difference between ZERO and dSignR being more than the preset value V1 in step ST14, is the driving concentration determination unit checks whether a value of LANEX is greater than a preset value (V2) (ST16). For reference, comparison reference values V3 to V7 to be mentioned later in addition to the values V1 and V2 are calculation values empirically obtained through actual implementation over several intervals.

In particular, the system then determines whether the value of LANEX is greater than the preset value V2 in (ST16), since this indicates that the side of the vehicle violates (is crossing over) an adjacent line due to possibly drowsiness and negligence. Based on this determination, the driving concentration determination unit 11 determines that the driver's concentration level is at a level 1 which is a very low level (ST17). In response, the driving concentration determination unit 11 controls the warning display unit 20 to output a warning message informing the driver of a danger as shown in FIG. 3 (ST25).

In some embodiments of the present invention, when the violation time is less than 0.5 sec, the system interprets the driver's divergence over the adjacent line as unlikely to cause an accident and thus, the level of danger is low. Therefore, when the calculation period is set to 10 msec, V2 is reasonably about 50.

As described above, after the driving concentration is divided into very high concentration and very low concentration, a process of dividing the concentration into a medium level of concentration will be described. More specifically, when driving on a road having an increased change in a radius of curvature because of the road or a road that would require the driver to reduce speed rapidly, the method in which the system makes its determinations is changed so that its determinations are based on driving ability for each driver over the same road conditions. If the degree of difficulty of the road was not considered, errors may occur during the analyzation process.

When the value of LANEX is equal to or less than the value V'in step ST16 by considering the above-described points, the driving concentration determination unit 11 determines whether a value of SDST % is greater than the preset value V3 (ST18). For reference, SDST is increased over a curved road compared to a straight road. SDST is also increased when a driver is not familiar with a road or the driver cannot adapt due to his/her driving ability, in a road having the same radius of curvature. Therefore, a medium level driving concentration may be additionally subdivided based on the degree of difficulty of the road and further compute the driving concentration while considering the difficulty level of a road.

When it is determined that SDST %>V3 in step ST18, the driving concentration determination unit 11 determines the difficulty level of the road to be high (ST19), compares a value of TLC % to the reference value V5 (ST20), and determines the driving concentration to be at a level 2 when TLC %<V5 (ST21).

When it is determined that the value of TLC % is equal to or greater than the reference value V5 in step ST20, the driving concentration determination unit 11 compares a value of SDLP % to the reference value V7 (ST22), determines the driving concentration to be at a level 3 when SDLP %>V7 as a determination result in step ST22 (ST23), and determines the driving concentration to be at a level 4 when the value of SDLP % is equal to or less than V7 (ST24).

On the other hand, when it is determined that the value of SDST % is equal to or less than V3 as a comparison result of SDST % to V3 in step ST18, the driving concentration determination unit 11 determines the difficulty level of the road is low (ST29), compares the value of TLC % to the reference value V4 (ST30), and determines the driving concentration to be at a level 3 when TLC %<V4 (ST21).

In addition, when it is determined the value of TLC % is equal to or greater than the reference value V4 in step 30, the driving concentration determination unit 11 compares the value of SDLP % to the reference value V6 (ST32), determines the driving concentration to be at a level 3 when SDLP %>V6 as a comparison result in step S32 (ST23), and determines the driving concentration to be at a level 4 when the value of SDLP % is equal to or less than V6 (ST24).

The driving concentration determination unit 11 counts the number (C) of times when the driving concentration reaches level 4 in step 24 (ST33), detects when the number of times is equal to or greater than a reference value V8 (ST34), updates the standard value which is a comparison reference value as average values of SDSTmax, and SDLPmax, and TLCmin when C≥V8, and initializes a value of C. Upon doing so, the system has completed one complete cycle and therefore is terminated (ST35).

According to the exemplary embodiment, it is possible to calculate a driver's driving concentration using an SAS of a steering wheel (handle) and a front camera sensor originally mounted in a vehicle, subdivide the driving concentration into several stages according to circumstances and symptoms, and provide a difficulty level of a road representing individual deviation according to the individual driving ability of a driver.

In addition, although values set during manufacture of a vehicle are generally used as reference values for determining driving concentration, in the exemplary embodiment, it is possible to dynamically correct a concentration difference due to deviation for each driver by deriving a value which correlates with an individual driver's abilities which is obtained by continually monitoring the driver's driving abilities through a continuous concentration determination. After a certain amount of data has been obtained, the derived values are reset as the reference values to better represent the "norm" of a particular driver.

In the above illustrative embodiment, the control unit may be embodied as a controller or processor configured to execute the above processes. Furthermore, the control logic within the controller or processor of the present invention may be embodied as non-transitory computer readable media on a computer readable medium containing executable program instructions executed by the processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for determining driving concentration of a vehicle driver, the system comprising:

a steering angle sensor configured to sense displacement of a steering wheel;

a front camera sensor configured to sense an object on a road and within a predetermined area in front of a vehicle;

a data storage unit configured to store data obtained from the steering angle sensor and the front camera sensor at a predetermined time interval, accumulate a value calculated by an index calculation unit and manage the accumulated value as a standard value, according to a predetermined control data;

the index calculation unit configured to calculate a quantitative index configured to recognize a vehicle's status based on the data obtained from the steering angle sensor and the front camera sensor and stored in the data storage unit, according to a predetermined control data;

a statistic processing unit configured to statistically process the value calculated by the index calculation unit and output status information which is an index for determining driving concentration; and a driving concentration determination unit configured to sequentially control the index calculation unit and the statistic processing unit based on the data stored in the data storage unit to calculate the status information and compare the calculated status information to the standard value stored in the data storage unit to determine a driver's level of driving concentration, wherein the status information includes a standard deviation of steering wheel angle (SDST), a maximum value (SDSTmax) of the standard deviation of the steering wheel angle (SDST), a variation factor (SDST %) of the maximum value (SDSTmax), a standard deviation of the vehicle's lateral position in a lane (SDLP), a maximum value (SDLPmax) of the standard deviation of the vehicle's lateral position in the lane (SDLP), and a variation factor (SDLP %) of the maximum value (SDLPmax).

2. The system of claim 1, further comprising a warning display unit configured to output a warning message warning the driver of danger according to a predetermined control data based on the driver's level of concentration, wherein the driving concentration determination unit controls the warning display unit to output the warning message when a calculation result of the statistic processing unit is equal to or less than a predetermined reference value.

3. The system of claim 1, wherein the driving concentration determination unit, the index calculation unit, and the statistic processing unit are embodied within a control unit configured as an electronic control unit (ECU).

4. A method of determining driving concentration of a vehicle driver, the method comprising:

storing, by a storage unit, output data obtained from a steering angle sensor and a front camera sensor mounted in a vehicle at a predetermined time interval;

calculating, by a control unit, a quantitative index including a value to recognize a vehicle's status based on the output data obtained from the steering angle sensor and the front camera sensor and stored in the storage unit;

statistically processing, by the control unit, the calculated value to output status information which is an index for determining driving concentration of a driver; and comparing, by the control unit, the information calculated in the statistically processing to the predetermined reference data and determining the level of driving concentration according to a comparison result, wherein the status information includes a standard deviation of steering wheel angle (SDST), a maximum value (SDSTmax) of the standard deviation of the steering wheel angle (SDST), a variation factor (SDST %) of the maximum value (SDSTmax), a standard deviation of the vehicle's lateral position in a lane (SDLP), a maximum value (SDLPmax) of the standard deviation of the vehicle's lateral position in the lane (SDLP), and a variation factor (SDLP %) of the maximum value (SDLPmax).

5. The method of claim 4, wherein the reference data is acquired by accumulating a result calculated by the control unit either during the calculation of the quantitative index or during statistically processing at predetermined times through a statistics process.

6. The method of claim 5, wherein the status information calculated in the statistically processing is configured of at least one parameter which subdivides the vehicle's status, and the reference data is subdivided so that the subdivided reference data is one-to-one compared to a corresponding parameter.

7. The method of claim 6, further comprising determining a degree of difficulty of a road based on the state information calculated in the statistically processing, wherein determining the driving concentration includes determining subdivided driving concentration by applying different reference values step by step according to a determination result while determining the difficulty level of a road.

8. The method of claim 6, wherein the parameter includes a difference between a number (ZERO) of sign change of a steering angle and a number (dSignR) of sign change of a radius of curvature of a road, wherein the determining the driving concentration includes first determining the driving concentration to be at a maximum level when ZERO−dSignR=0 and a value of SDST % is less than a preset value V1.

9. The method of claim 8, wherein, when a value of a corresponding parameter is not matched to a condition at the maximum level, determining the driving concentration further includes a determining the driving concentration to be at a minimum level when a number of lane exceedance (LANEX) is greater than a preset value V2.

10. The method of claim 7, wherein the determining the degree of difficulty of a road includes determining the difficulty level of a road to be at a low level when the value of SDST % is greater than a preset value V3 and at a high level when the value of SDST % is equal to or less than the preset value V3.

11. The method of claim 10, wherein the parameter includes a minimum value TLCmin of a time to line crossing (TLC) until a side of a vehicle reaches an adjacent line, and a variation factor (TLC %) in TLCmin measured for $TLCmin_{13}$ s which is a standard value of TLCmin, wherein the determining the driving concentration further includes determining the driving concentration to be at a level 2 when a value of TLC % is less than a predetermined reference value V4 when the road has a low degree of difficulty in the determining the difficulty level of the road, or when the value of TLC % is less than a predetermined reference value V5 when the road has a high degree difficulty in the determining the difficulty level of a road.

12. The method of claim 11, wherein the determining the driving concentration further includes determining the driving concentration to be at a level 3 when the value of SDLP % is greater than a predetermined reference value V6 when the road has a low degree of difficulty , or when the value of SDLP % is greater than a predetermined reference value V7 when the road has a high degree of difficulty.

13. The method of claim 12, wherein the determining the driving concentration further includes determining the driving concentration when the value of SDLP % does not satisfy a criterion of the level 3 to be at a level 4.

14. The method of claim 13, further, after the determining the driving concentration, comprises:

counting a number of times that the driving concentration reaches the level 4; and resetting a parameter when the number of times reaches a predetermined value, as the reference data.

* * * * *